US009169591B2

(12) United States Patent
Atsushi et al.

(10) Patent No.: US 9,169,591 B2
(45) Date of Patent: Oct. 27, 2015

(54) WASHING MACHINE WITH BALANCING DEVICE HAVING FLUID ACCOMMODATION PORTION

(71) Applicant: SAMSUNG ELECTRONICS CO., LTD., Suwon-si, Gyeonggi-do (KR)

(72) Inventors: Ohyagi Atsushi, Osaka (JP); Ikeda Izumi, Osaka (JP)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 30 days.

(21) Appl. No.: 14/022,704

(22) Filed: Sep. 10, 2013

(65) Prior Publication Data

US 2014/0076003 A1 Mar. 20, 2014

(30) Foreign Application Priority Data

Sep. 14, 2012 (JP) ..... 2012-202282
Sep. 24, 2012 (JP) ..... 2012-209179
Jun. 5, 2013 (KR) ..... 10-2013-0064893

(51) Int. Cl.
*D06F 37/24* (2006.01)
*D06F 21/06* (2006.01)

(52) U.S. Cl.
CPC ..... *D06F 37/245* (2013.01); *D06F 21/06* (2013.01)

(58) Field of Classification Search
CPC ..... D06F 37/245; D06F 21/06; D06F 21/08; D06F 37/24
USPC ..... 68/131
See application file for complete search history.

(56) References Cited

U.S. PATENT DOCUMENTS 5,857,360 A * 1/1999 Kim et al. ..... 68/23.2
6,082,151 A * 7/2000 Wierzba et al. ..... 68/23.2
2003/0110814 A1* 6/2003 Southworth et al. ..... 68/23.2

* cited by examiner

*Primary Examiner* — Michael Barr
*Assistant Examiner* — Rita Adhlakha
(74) *Attorney, Agent, or Firm* — Staas & Halsey LLP

(57) ABSTRACT

A washing machine provided with a balancing device which may suppress variation in horizontal vibration of a spin basket without performing control operation. The balancing device includes a ring-shaped casing installed to be concentric with the spin basket, and a plurality of the balancing balls and a viscous fluid. A ring-shaped ball accommodation portion, a fluid accommodation portion provided at a lower inner side of the ball accommodation portion in a radial direction of the ball accommodation portion, and a communication channel are formed in the casing. The fluid accommodation portion is provided at a portion of the casing along a circumferential direction of the casing. A bottom surface of the ball accommodation portion is inclined downward such that the balancing balls gather at the opposite position facing the fluid accommodation portion when rotation of the spin basket is stopped.

8 Claims, 11 Drawing Sheets

WASHING MACHINE WITH BALANCING DEVICE HAVING FLUID ACCOMMODATION PORTION

CROSS-REFERENCE TO RELATED APPLICATIONS

This application claims the benefit of Japanese Patent Applications Nos. 2012-209179 and 2012-202282, both filed on Sep. 14, 2012 in the Japanese Patent Office, and Korean Patent Application No. 10-2013-0064893, filed on Jun. 5, 2013 in the Korean Intellectual Property Office, the disclosures of which are incorporated herein by reference.

BACKGROUND

1. Field

Embodiments of the present disclosure relate to a washing machine having an outer tub, a spin basket rotatably installed in the outer tub, and a balancing device mounted to the spin basket.

2. Description of the Related Art

Conventionally, a washing machine having an outer tub and a spin basket rotatably installed in the outer tub to perform washing, rinsing and drying of laundry such as clothing accommodated in the spin basket has been known.

The conventional washing machine is subjected to vibration when the spin basket having laundry accommodated therein rotates to perform drying operation. This vibration mainly results from uneven distribution of the laundry accommodated in the spin basket. Accordingly, a ball balancer to damp the vibration is mounted to the spin basket.

Specifically, the ball balancer is formed in a ring shape, and is provided with a plurality of balancing balls accommodated in an accommodation chamber and viscous fluid. The balancing balls and viscous fluid are allowed to move in the accommodation chamber in the circumferential direction of the accommodation chamber. The balancing balls are submerged in the viscous fluid and thus movement thereof is limited to an extent. Thereby, self-excited vibration of the balancing balls revolving in the accommodation chamber may be restricted. During rotation of the spin basket, the balancing balls are moved in the accommodation chamber in the circumferential direction by centrifugal force and finally positioned at the side opposite to the maldistributed laundry. As a result, balanced rotation of the spin basket is maintained by the weight of the balancing balls.

In the case that the positioned balancing balls fail to perform balancing during stoppage of rotation of the spin basket before start of the drying operation, the maldistribution of the balancing balls causes variation in magnitude of horizontal vibration (rocking rotation) of the spin basket while the rate of rotation of the spin basket crosses a first resonance section. If the horizontal vibration of the spin basket is large, the outer tub may collide with the outer casing. In addition, when the outer tub collides with the outer casing, control is generally performed to force the drying operation to be terminated. This may waste energy and time.

In the case of the conventional washing machine, a recessed accommodation portion to accommodate the balancing balls is formed on the bottom surface of the accommodation chamber. Thereby, unbalanced positioning of the balancing balls before start of the drying operation of the washing machine is resolved. Accordingly, when the rate of rotation of the spin basket passes the first resonance section, variation of the horizontal vibration of the spin basket due to maldistribution of the balancing balls may be suppressed.

However, the conventional washing machine has a viscous fluid accommodated in the accommodation chamber. Thereby, movement of the balancing balls may be restricted by the viscous resistance of the viscous fluid, and thus it may be difficult to accommodate the balancing balls in the recessed accommodation portion.

In this regard, a control operation may be performed to decelerate or accelerate rotation of the spin basket to move the balancing balls to positions where weight balance is formed between the balancing balls and the viscous fluid.

However, this control may take energy and time.

SUMMARY

Therefore, it is an aspect of the present disclosure to provide a washing machine which may suppress variation of horizontal vibration of the spin basket caused by maldistribution of the balancing balls when the rate of rotation of the spin basket passes the first resonance section, even without moving the balancing balls to positions where weight balance is formed between the balancing balls and the viscous fluid.

Additional aspects of the disclosure will be set forth in part in the description which follows and, in part, will be apparent from the description, or may be learned by practice of the disclosure.

According to the present disclosure, a ball accommodation portion has a bottom surface inclined such that, when rotation of a spin basket is stopped, balancing balls gather at a position opposite to the side of a fluid accommodation portion.

In accordance with one aspect of the present disclosure, a washing machine includes an outer tub, a spin basket rotatably installed in the outer tub, and a balancing device mounted to the spin basket.

The balancing device includes a ring-shaped casing installed to be concentric with the spin basket, and a plurality of balancing balls and a viscous fluid, the balancing balls and the viscous fluid being accommodated in the casing. A ring-shaped ball accommodation portion to accommodate the balancing balls, a fluid accommodation portion provided at a lower inner side of the ball accommodation portion in a radial direction of the ball accommodation portion to accommodate the viscous fluid, and a communication channel allowing the ball accommodation portion to communicate with the fluid accommodation portion are formed in the casing. The fluid accommodation portion is provided at a portion of the casing along a circumferential direction of the casing. A bottom surface of the ball accommodation portion is inclined downward as the bottom surface extends from a position of the fluid accommodation portion to an opposite position such that the balancing balls gather at the opposite position facing the fluid accommodation portion when rotation of the spin basket is stopped.

According to the above description, the bottom surface of the ball accommodation portion is inclined downward as the bottom surface extends from a position of the fluid accommodation portion to an opposite position such that the balancing balls gather at the opposite position facing the fluid accommodation portion when rotation of the spin basket is stopped. Thereby, when rotation of the spin basket is stopped, weight balance is automatically formed among the balancing balls and the viscous fluid in the ball accommodation portion and the viscous fluid in the fluid accommodation portion. As a result, variation in horizontal vibration of the spin basket due to maldistribution of the balancing balls may be suppressed when the rate of rotation of the spin basket passes the first resonance section, even without moving the balancing balls to a position at which weight balance is formed between the balancing balls and the viscous fluid.

A majority of the viscous fluid is accommodated in the fluid accommodation portion and a remaining portion of the viscous may be accommodated in the ball accommodation portion, when rotation of the spin basket is stopped, and the balancing device is configured such that weight balance is formed, when rotation of the spin basket is stopped, among the balancing balls having gathered at the opposite position to the fluid accommodation portion, the viscous fluid in the ball accommodation portion, and the viscous fluid in the fluid accommodation portion.

According to the above description, the balancing device is configured such that weight balance is formed, when rotation of the spin basket is stopped, among the balancing balls having gathered at the opposite position to the fluid accommodation portion, the viscous fluid in the ball accommodation portion, and the viscous fluid in the fluid accommodation portion. Thereby, when rotation of the spin basket is stopped, weight balance is automatically formed among the balancing balls, the viscous fluid in the ball accommodation portion, and the viscous fluid in the fluid accommodation portion. As a result, variation in horizontal vibration of the spin basket due to maldistribution of the balancing balls may be suppressed when the rate of rotation of the spin basket passes (crosses) the first resonance section, even without moving the balancing balls to a position at which weight balance is formed between the balancing balls and the viscous fluid.

The communication channel may be configured not to allow the balancing balls to move from the ball accommodation portion to the fluid accommodation portion, and the balancing device is configured such that when a rate of rotation of the spin basket is lower than a predetermined rate of rotation, the viscous fluid is accommodated in the fluid accommodation portion due to gravity, and when the rate of rotation of the spin basket is equal to or higher than the predetermined rate of rotation, the viscous fluid in the fluid accommodation portion is moved into the ball accommodation portion through the communication channel by centrifugal force.

According to the above description, the balancing device is configured such that when a rate of rotation of the spin basket is lower than a predetermined rate of rotation, the viscous fluid is accommodated in the fluid accommodation portion due to gravity, and when the rate of rotation of the spin basket is equal to or higher than the predetermined rate of rotation, the viscous fluid in the fluid accommodation portion is moved into the ball accommodation portion through the communication channel by centrifugal force. Thereby, the balancing balls are submerged in the viscous fluid and movement thereof is limited by the viscous resistance of the viscous fluid when the rate of rotation of the spin basket is equal to or higher than the predetermined rate of rotation. As a result, during rotation of the spin basket, self-excited vibration by the balancing balls may be attenuated.

The casing may include a casing body having an opening open upward, and a cover to cover the opening of the casing body, wherein a partition wall may be integrally formed on a lower surface of the cover to protrude downward from the lower surface to partition the communication channel.

According to the above description, partition wall may be integrally formed on a lower surface of a casing cap to protrude downward from the lower surface to partition the communication channel. Thereby, the casing cap may be used to form the communication channel.

The balancing device may include the ring-shaped casing installed to be concentric with the spin basket, and a plurality of balancing ball groups of the balancing balls, and a viscous fluid, the balancing balls and the viscous fluid being accommodated in the casing, and each of the balancing ball groups including balancing balls of the balancing balls having the same diameter, wherein a diameter of the balancing balls included in one of the balancing ball groups is different from a diameter of the balancing balls included in another one of the balancing ball groups, the ball accommodation portion to accommodate the balancing ball groups is formed in the casing, wherein the ball accommodation portion is provided with a plurality of ring-shaped concave portions having different radial widths and integrally stacked such that the radial width of one of the concave portions is smaller than the radial width of another one of the concave portions positioned below the one of the concave portions, the balancing balls in each of the balancing ball groups is accommodated in one of the concave portions having a radial width corresponding to the diameter of the balancing balls, a bottom surface of each of the concave portions is inclined in a circumferential direction such that, when rotation of the spin basket is stopped, the balancing balls included in each of the balancing ball groups move by rolling and gather at a lowest position on the bottom surface to cause a center of gravity of the balancing ball groups to coincide with an axis of rotation of the spin basket.

According to the above description, the ball accommodation portion in the casing is provided with a plurality of concave portions having different radial widths and integrally stacked in a vertical direction, and the radial width of the ball accommodation portion is reduced as it extends downward. In addition, a balancing ball group including balancing balls having a diameter corresponding to the radial width of a corresponding concave portion with a bottom surface inclined in a circumferential direction is accommodated in the corresponding concave portion. The balancing balls accommodated in the corresponding concave portion move by rolling on the bottom surface in a circumferential direction of the concave portion and gather when rotation of the spin basket is stopped, such that the center of gravity of the balancing ball groups coincides with the axis of rotation of the spin basket. Since the balancing balls roll on the bottom surfaces of the respective concave portions and gather at one place due to gravity, thereby automatically forming weight balance, special control is not needed as in conventional cases. Accordingly, waste of time and energy may be prevented.

In addition, the balancing device has a simple structure in which ring-shaped concave portions having different radial widths are vertically stacked, a ball accommodation portion has concave portions each of which has a bottom surface inclined in a circumferential direction, and a plurality of balancing balls is accommodated in the respective concave portions, manufacture may be facilitated and manufacturing cost may be lowered.

Each of the concave portions may be disposed radially outward when extending downward, and each of the concave portions is provided with inner and outer circumferential walls formed in a shape of an approximately vertical round pipe, and the bottom surface formed in a shape of a flange extending from a lower end of the inner circumferential wall in a radially outward direction, wherein each inner circumferential wall extends upward from a radially outer edge of the bottom connected thereto, and each outer wall is connected with the outer circumferential wall of the concave portion vertically adjoining the each outer wall, and each of the balancing ball groups is pushed against the outer circumferential wall by centrifugal force to move upward along the outer circumferential wall when a rate of rotation of the spin basket is equal to or higher than a predetermined rate of rotation.

According to the above description, the outer wall of each concave portion is inclined upward in a radially outward direction, and is connected to an outer wall of a concave portion vertically adjacent thereto, and accordingly, when the balancing balls accommodated in each concave portion is moved upward along the outer circumferential wall of the concave portion when the rate of rotation of the spin basket is equal to or higher than a predetermined rate of rotation. For example, when the predetermined rate of rotation is over the first resonance section, the balancing ball groups move in the casing along a circumferential direction, and thus weight balance of the spin basket may be formed. In addition, the inner circumferential wall of each concave portion is connected to the outer edge of the bottom surface of another concave portion positioned at the upper side of the concave portion. Therefore, when the rate of rotation of the spin basket is relatively low, the balls fall down. At this time, the large-diameter balancing balls are first stopped by a bottom surface. Then, the balancing balls roll along the slope of the bottom surfaces in a circumferential direction to form weight balance. As such, after rotation of the spin basket is stopped, the balancing balls may autonomously form the weight balance.

The bottom surface may be inclined downward in a radially outward direction.

That is, since the bottom surface of each concave portion is inclined downward in a radially outward direction, small-diameter balancing balls move by rolling on this bottom surface in a radially outward direction and fall on a concave portion below each concave portion. Accordingly, the small-diameter balancing balls may be prevented from staying on the bottom surface of each concave portion.

The ball accommodation portion may include two concave portions vertically stacked, and the balancing ball groups includes a first balancing ball group including first balancing balls and a second balancing ball group including second balancing balls having a diameter smaller than a diameter of the first balancing balls, wherein a ratio of the diameter of the second balancing balls to the diameter of the first balancing balls is between about 0.25 and about 0.9.

According to the above description, two kinds of ball balancing groups are used, and accordingly the ball accommodation portion has at least two steps. Therefore, a compact balancing device may be realized. In addition, since the ratio of the diameter of the small-diameter balancing balls to the diameter of the large-diameter balancing balls is between about 0.25 and about 0.9, the area of the portion of the large-diameter balancing ball stuck in the concave portion accommodating the small-diameter balancing balls decreases, and therefore, the large-diameter balancing balls may move easily in a circumferential direction.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Reference will now be made in detail to the embodiments of the present disclosure.

Figure 1:
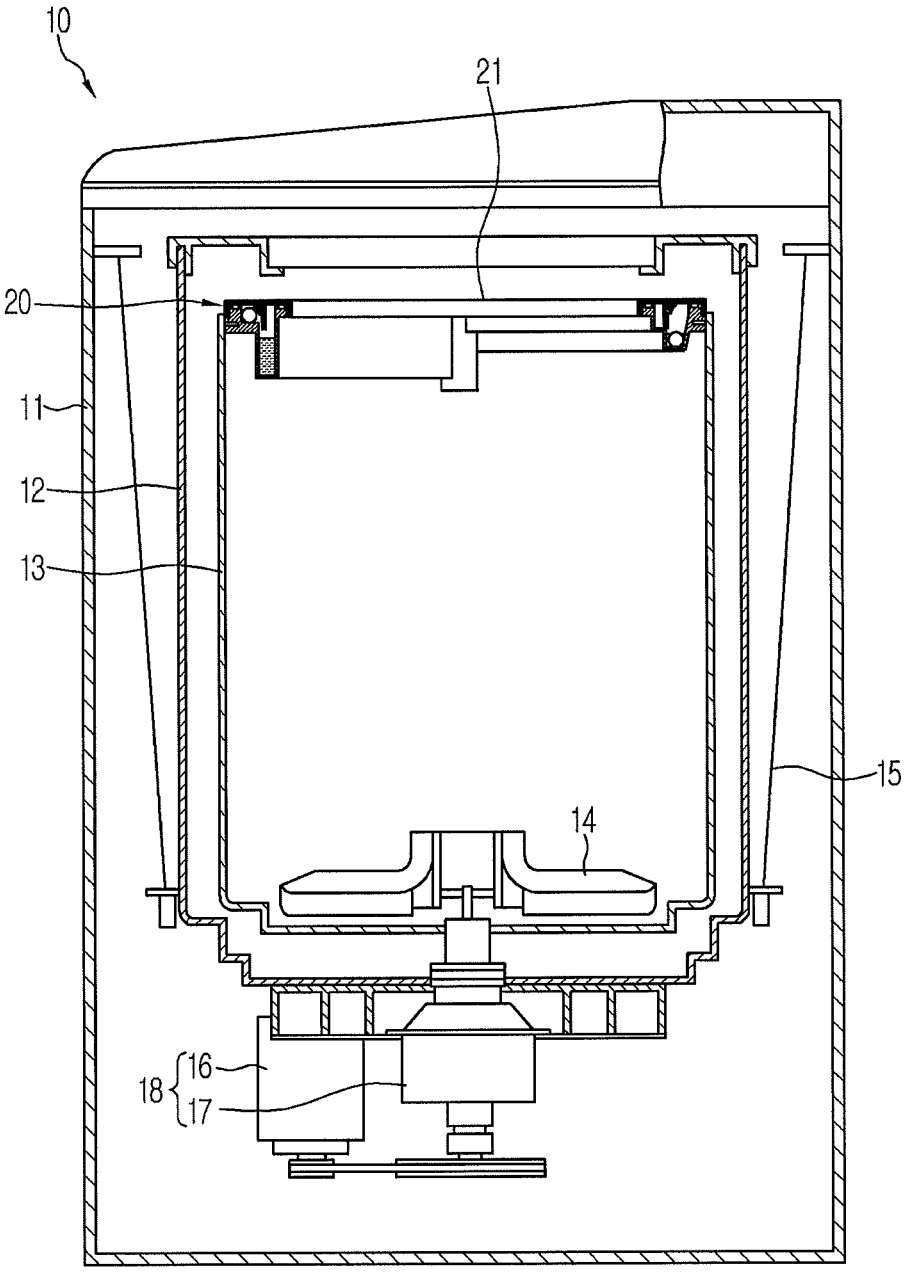
FIG. 1 is a longitudinal cross-sectional view showing a washing machine according to an exemplary embodiment of the present disclosure.

Hereinafter, embodiment of the present disclosure will be described in detail with reference to the accompanying drawings, wherein like reference numerals refer to like elements throughout. The embodiments are simply illustrative and are not intended to limit the present disclosure, FIG. 1 is a longitudinal cross-sectional view showing a bell-shaped electric washing machine (hereinafter, referred to as a washing machine). As shown in FIG. 1, the washing machine 10 includes an outer casing 11, an outer tub 12 (also referred to as a water tub), a spin basket 13 (also referred to as a washing tub), and a balancing device 20 (also referred to as a ball balancer).

The outer casing 11 is formed in the shape of an approximately rectangular box having a bottom. The outer tub 12 is elastically supported through a suspension 15 in the outer casing 11. That is, the suspension 15 connects the outer casing 11 to the outer tub 12. In addition, the suspension 15 damps vibration of the outer tub 12. Washing water is accommodated in the outer tub 12. The outer tub 12 is formed in the shape of a cylinder having a bottom.

The spin basket 13 is rotatably installed in the outer tub 12. Laundry is accommodated in the spin basket 13. The spin basket 13 is formed in the shape of a cylinder having a bottom. A pulsator 14 is installed at the bottom of the spin basket 13. The pulsator 14 produces rotating water streams in the spin basket 13. A plurality of through holes (not shown) is formed in the wall of the spin basket 13. The through holes allow the spin basket 13 to share washing water with the outer tub 12.

A power transmission unit 18 is installed at the bottom of the outer tub 12. The power transmission unit 18 is provided with a driving motor 16 and a shaft assembly 17. The driving motor 16 is connected with the pulsator 14. The power transmission unit 18 selectively rotates the spin basket 13 or the pulsator 14 in a forward or reverse direction according to a program of a control unit (not shown). Thereby, washing, rinsing and drying of the laundry in the spin basket 13 are sequentially performed.

The balancing device 20 is mounted to the upper inner surface of the spin basket 13. The balancing device 20 serves to maintain balance of rotation of the spin basket 13. The balancing device 20 is formed in a circular ring shape.

Figure 2:
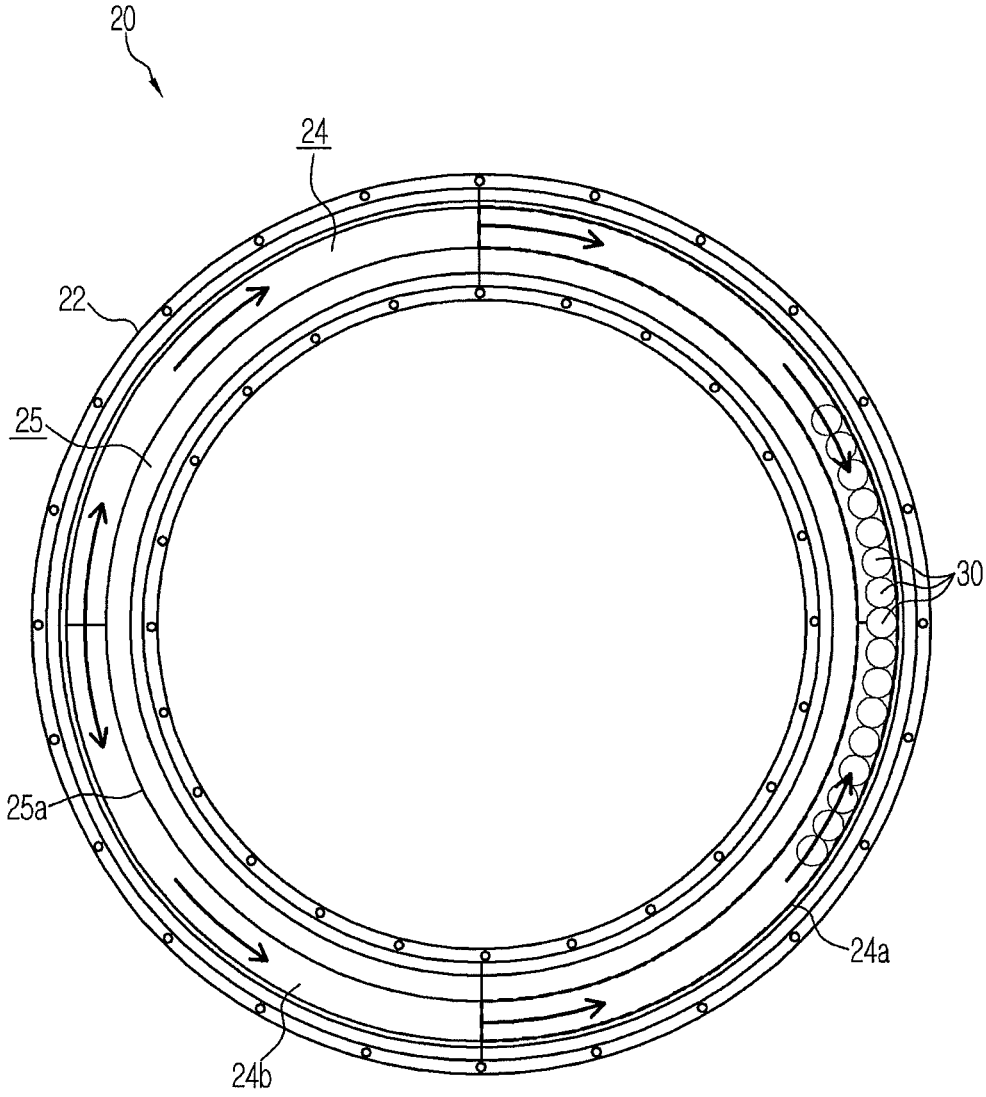
FIG. 2 is a plan view showing a balancing device with the cover of a casing removed from the casing.
Figure 3:
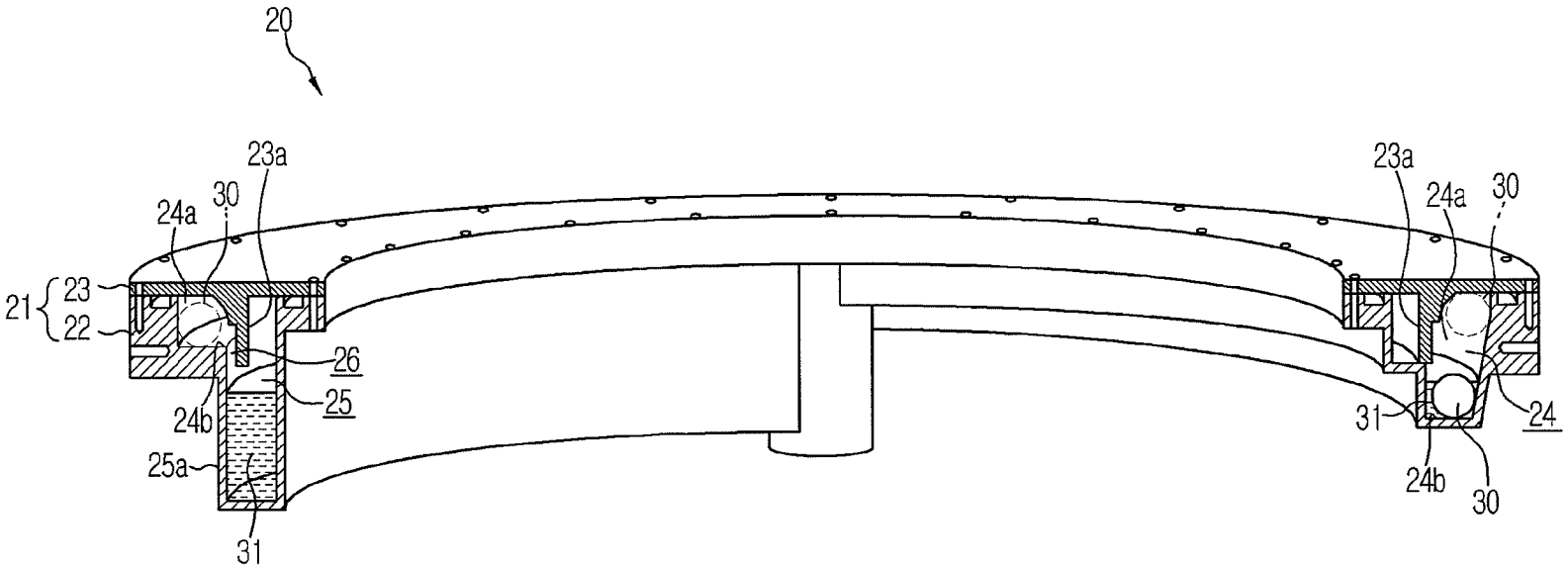
FIG. 3 is a perspective cross-sectional view showing a balancer with a portion thereof cut away.

FIG. 2 is a plan view showing a balancing device with the cover of a casing removed from the casing, and FIG. 3 is a perspective cross-sectional view showing a balancer with a portion thereof cut away. As shown in FIGS. 1 to 3, the balancing device 20 includes a casing 21, and a plurality of the balancing balls 30 and a viscous fluid 31 accommodated in the casing 21. In this embodiment, sixteen balancing balls 30 are provided.

The casing 21 is installed to be concentric with the spin basket 13. The casing 21 is formed in a circular ring shape. The casing 21 has a casing body 22 and a cover 23. The casing body 22 has an opening open upward. The cover 23 covers the upper side of the opening of the casing body 22. Formed in the casing 21 are a ball accommodation portion 24 (also referred to as a race), a fluid accommodation portion 25 (also referred to as a tank), and a communication channel 26.

The balancing balls 30 are accommodated in the ball accommodation portion 24. The ball accommodation portion 24 is formed in a circular ring shape. The outer lateral surface 24*a* of the ball accommodation portion 24 facing in the radial direction is inclined upward throughout the whole circumference of the ball accommodation portion 24 as it extends outward.

The fluid accommodation portion 25 is provided under the inner side of the ball accommodation portion 24 in a radial direction. The viscous fluid 31 is accommodated in the fluid accommodation portion 25. The fluid accommodation portion 25 is provided along a portion of the circumference of the casing 21. In the illustrated embodiment, the fluid accommodation portion 25 is arranged along a half of the circumference of the casing 21. That is, the fluid accommodation portion 25 has a semi-circular ring shape. The fluid accommodation portion 25 is set to have a volume allowing weight balance to be formed, when rotation of the spin basket 13 is stopped, among the balancing balls 30 collected at a position opposite to the fluid accommodation portion 25, the viscous fluid 31 in the ball accommodation portion 24, and the viscous fluid 31 in the fluid accommodation portion 25.

The bottom surface 24*b* of the ball accommodation portion 24 is inclined downward from the location of the fluid accommodation portion 25 to the opposite side, such that the balancing balls 30 gather at one place opposite to the fluid accommodation portion 25 when rotation of the spin basket 13 is stopped. Specifically, the bottom surface 24*b* of the ball accommodation portion 24 has the highest vertical position at a portion corresponding to the center of the fluid accommodation portion 25 in the circumferential direction (the left end portion of the bottom surface 24*b* in FIGS. 2 and 3). From this portion, the bottom surface 24*b* is gradually lowered as it extends to the opposite side of the fluid accommodation portion 25. The bottom surface 24*b* of the ball accommodation portion 24 has the lowest point at a portion of the bottom surface 24*b* facing the highest portion of the bottom surface 24*b* in the radial direction (the right end portion of the bottom surface 24*b* in FIGS. 2 and 3). That is, the balancing balls 30 gather in a predetermined portion including the portion at the lowest position when rotation of the spin basket 13 is stopped.

The bottom surface 24*b* of the ball accommodation portion 24 is set to have an inclination angle allowing the balancing balls 30 to gather at one place at the opposite side of the fluid accommodation portion 25 even if the laundry is maldistributed in the spin basket 13 when rotation of the spin basket 13 is stopped. Specifically, the inclination angle of the bottom surface 24*b* of the ball accommodation portion 24 is greater than or equal to about 1°. More specifically, it may be equal to or greater than about 2.5°.

The communication channel 26 allows the ball accommodation portion 24 to communicate with the fluid accommodation portion 25. The communication channel 26 does not allow the balancing balls 30 to move from the ball accommodation portion 24 to the fluid accommodation portion 25. That is, the width of the casing of the communication channel 26 in a radial direction is less than the outer diameter of the balancing balls 30. Thereby, while the balancing balls 30 remain accommodated in the ball accommodation portion 24, the viscous fluid 31 is allowed to move between the ball accommodation portion 24 and the fluid accommodation portion 25 through the communication channel 26. The width of the communication channel may be, for example, between about 2 mm to 8 mm. This range may save space.

The communication channel 26 is partitioned by an inner partition wall 23*a* and an outer partition wall 25*a*. The inner partition wall 23*a* is integrated with the casing cap 23 to protrude downward from the lower surface of the casing cap 23 along the entire circumferential length. Thereby, the casing cap 23 may be used to form the communication channel 26. The portion of the inner partition wall 23*a* corresponding to the fluid accommodation portion 25 protrudes farther downward than the bottom surface 24*b* of the ball accommodation portion 24. The inner partition wall 23*a* is formed in a circular ring shape. The outer partition wall 25*a* is formed by the outer side wall of the fluid accommodation portion 25 in the radial direction.

The casing 21 is adapted to form weight balance for itself. Specifically, the casing 21 is provided with a weight at a predetermined position such that the weight balance is formed by itself.

The balancing balls 30 are formed of a metal such as aluminum or iron. The balancing balls 30 are set to cancel the expected maximum maldistribution of the laundry in the spin basket 13. The balancing balls 30 designed as above may attenuate vibration against the expected maximum maldistribution of the laundry or a maldistribution of the laundry weaker than the expected maximum maldistribution. The outer diameter of the balancing balls 30 may be, for example, about 20 mm. The balancing balls 30 are rotated around the ball accommodation portion 24 in a circumferential direction by rotation of the spin basket 13.

The viscous fluid 31 is formed of oil having a predetermined viscosity. The total weight of the viscous fluid 31 is greater than that of the balancing balls 30. The viscous fluid 31 is mainly accommodated in the fluid accommodation portion 25 when rotation of the spin basket 13 is stopped or when the rate of rotation of the spin basket 13 is lower than a first predetermined rate of rotation below the first resonance section (see FIG. 4). Herein, the first resonance section is a range of rate of rotation in which the horizontal vibration (rocking rotating) of the spin basket 13 is maximized at the initial stage of the drying operation. In this embodiment, about 80% to 90% of the viscous fluid 31 is accommodated in the fluid accommodation portion 25. The remaining portion of the viscous fluid 31 is accommodated in the ball accommodation portion 24. Specifically, the remaining portion of the viscous fluid 31 is accommodated in the half the circumferential length of the ball accommodation portion 24 positioned at the opposite to the fluid accommodation portion 25. In addition, the viscous fluid 31 in the fluid accommodation portion 25 and the viscous fluid 31 in the ball accommodation portion 24 forms a continuous surface when rotation of the spin basket 13 is stopped.

Meanwhile, the viscous fluid 31 in the fluid accommodation portion 25 is moved into the ball accommodation portion 24 through the communication channel by centrifugal force according to rotation of the spin basket 13. In addition, the optimum section of rates of rotation of the spin basket for movement of the viscous fluid 31 from the fluid accommodation portion 25 into the ball accommodation portion 24 is larger than the first resonance section and smaller than the second resonance section. Herein, the second resonance section is the range of rate of rotation in which the vertical vibration of the spin basket 13 is maximized. The section of rate of rotation in which self-excited vibration occurs is the range of rate of rotation above than the second resonance section. In addition, when rotation of the spin basket 13 is stopped, the surface of the viscous fluid 31 becomes higher than the portion of the bottom surface 24*b* of the ball accommodation portion 24 corresponding to both ends of the fluid accommodation portion 25 in the circumferential direction such that the viscous fluid 31 moving from the fluid accommodation portion 25 into the ball accommodation portion 24 moves back to the fluid accommodation portion 25 through the communication channel 26 due to gravity.

Hereinafter, a description will be given of the drying operation of the washing machine 10.

When rotation of the spin basket 13 is stopped prior to start of the drying operation of the washing machine 10, the balancing balls 30 gather at one place at the opposite side facing the fluid accommodation portion 25 since the bottom surface 24*b* of the ball accommodation portion 24 is inclined downward from the fluid accommodation portion 25 to the opposite side of the fluid accommodation portion 25 (see FIG. 3). At this time, a majority of the viscous fluid 31 is accommodated in the fluid accommodation portion 25 and the remaining portion thereof is accommodated in the ball accommodation portion 24. In addition, weight balance is formed among the balancing balls 30 collected at one place opposite to the fluid accommodation portion 25, the viscous fluid 31 in the ball accommodation portion 24, and the viscous fluid 31 in the fluid accommodation portion 25 (the viscous fluid 31 in an area surrounded by a double dashed line in FIG. 2). This weight balance is maintained while the rate of rotation of the spin basket 13 is lower than the first predetermined rate of rotation. As such, when rotation of the spin basket 13 is stopped, weight balance is automatically formed among the balancing balls 30 and the viscous fluid 31 in the ball accommodation portion 24 and the viscous fluid 31 in the fluid accommodation portion 25. As a result, variation in horizontal vibration of the spin basket 13 due to maldistribution of the balancing balls 30 may be suppressed when the rate of rotation of the spin basket 13 passes (crosses) the first resonance section, even without moving the balancing balls to a position at which weight balance is formed between the balancing balls and the viscous fluid.

When the drying operation of the washing machine 10 begins, the spin basket 13 starts to rotate. At this time, the balancing device 20 mounted to the spin basket 13 also starts to integrally rotate.

When the rate of rotation of the spin basket 13 passes the first resonance section, the balancing balls 30 in the ball accommodation portion 24 is automatically moved to the position opposite to the maldistributed laundry. Thereby, balance of rotation of the spin basket 13 may be maintained.

At this time, the balancing balls 30 in the ball accommodation portion 24 are moved to the inner upper side of the ball accommodation portion along the outer lateral surface 24*a* in the radial direction of the ball accommodation portion 24 by centrifugal force according to rotation of the spin basket 13 (see the balancing balls 30 denoted by a double dashed line in FIG. 3).

Figure 4:
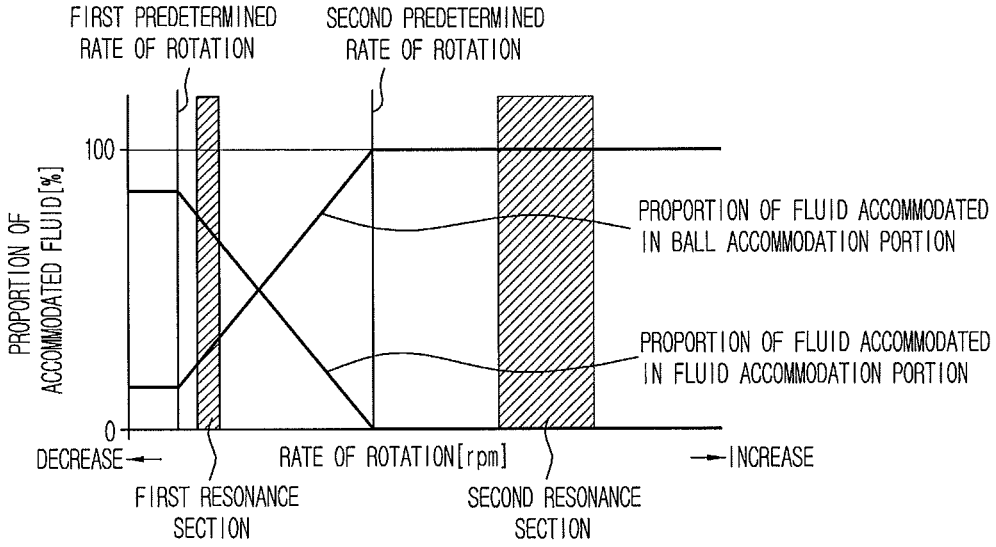
FIG. 4 is a graph illustrating a relationship between the rate of rotation of the spin basket and the proportion of the accommodated viscous fluid.

As shown in FIG. 4, when the rate of rotation of the spin basket 13 is lower than the first predetermined rate of rotation, the viscous fluid 31 in the fluid accommodation portion 25 remains in the fluid accommodation portion 25 due to gravity.

When the rate of rotation of the spin basket 13 is equal to or higher than the first predetermined rate of rotation, the viscous fluid 31 in the fluid accommodation portion 25 is moved into the ball accommodation portion 24 through the communication channel 26 by centrifugal force according to rotation of the spin basket 13. When the rate of rotation of the spin basket 13 becomes a second predetermined rate of rotation higher than the first resonance section and lower than the second resonance section, all the viscous fluid 31 in the fluid accommodation portion 25 is moved into the ball accommodation portion 24. Thereby, the balancing balls 30 are submerged in the viscous fluid 31 and movement thereof is limited by the viscous resistance of the viscous fluid 31. As a result, during rotation of the spin basket 13, self-excited vibration by the balancing balls 30 may be attenuated.

When the drying operation of the washing machine 10 is terminated and the rate of rotation of the spin basket 13 becomes lower than the first predetermined rate of rotation, the viscous fluid 31 moved from the fluid accommodation portion 25 to the ball accommodation portion 24 is recovered as it flows to the fluid accommodation portion 25 through the communication channel 26 due to gravity. Thereby, a majority of the viscous fluid 31 is accommodated in the fluid accommodation portion 25 and the remaining portion of the viscous fluid 31 is accommodated in the ball accommodation portion 24. As a result, the viscous fluid 31 returns to its original state.

When rotation of the spin basket 13 is stopped, the balancing balls 30 gather at one place opposite to the fluid accommodation portion 25 since the bottom surface 24*b* of the ball accommodation portion 24 is inclined downward from the location of the fluid accommodation portion 25 to the opposite side. Thereby, the balancing balls 30 returns to their original state.

Figure 5:
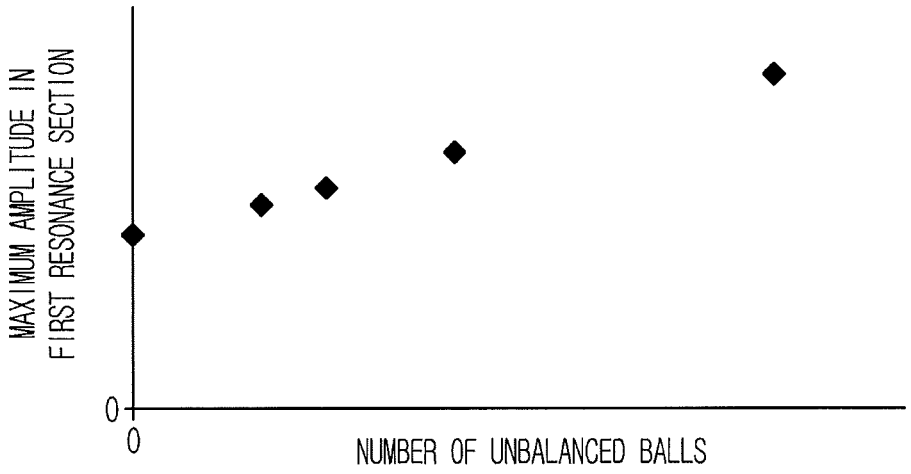
FIG. 5 is a graph illustrating a relationship between the state of weight balance between the balancing balls and the viscous fluid and variation in horizontal vibration of the spin basket.

FIG. 5 is a graph illustrating a relationship between weight balance formed by the balancing balls and the viscous fluid and variation in horizontal vibration of the spin basket. In FIG. 5, the horizontal axis represents the number of balancing balls that do not form weight balance with the viscous fluid, and the vertical axis represents the maximum amplitude of vibration of the spin basket when the rate of rotation of the spin basket passes the first resonance section. The illustrated embodiment corresponds to the case of having no balancing balls failing to form weight balance with the viscous fluid. As shown in FIG. 5, as the number of the balancing balls that do not form weight balance with the viscous fluid increases, the maximum amplitude of vibration of the spin basket increases and thus variation in horizontal vibration of the spin basket also increases. In addition, as the maximum amplitude of vibration of the spin basket increases, the possibility of collision between the outer tub and the outer casing increases.

While the bottom surface 24*b* of the ball accommodation portion 24 is illustrated as being inclined along the entire circumferential length, embodiments of the present disclosure are not limited thereto. A portion of the bottom surface 24*b* of the ball accommodation portion 24 corresponding to the balancing balls 30 gathering at one place opposite to the fluid accommodation portion 25 may be formed to be a horizontal plane and the other portion may be formed to be an inclined plane.

In addition, while the fluid accommodation portion 25 is illustrated as being arranged along half the circumferential length of the casing 21, the range in which the fluid accommodation portion 25 is arranged is not limited thereto so long as weight balance is formed between the balancing balls 30 and the viscous fluid 31 when rotation of the spin basket 13 is stopped. Herein, a narrower range of arrangement of the fluid accommodation portion 25 may save more space.

Further, in the illustrated embodiment, a majority of the viscous fluid 31 is accommodated in the fluid accommodation portion 25 when rotation of the spin basket 13 is stopped. However, embodiments of the present disclosure are not limited thereto. All the viscous fluid 31 may alternatively be accommodated in the fluid accommodation portion 25 when rotation of the spin basket 13 is stopped.

In addition, while the first predetermined rate of rotation is illustrated in the embodiment as being a rate of rotation below the first resonance section, embodiments of the present disclosure are not limited thereto. The first predetermined rate of rotation may alternatively be a rate of rotation above the first resonance section and below the second resonance section.

Figure 6:
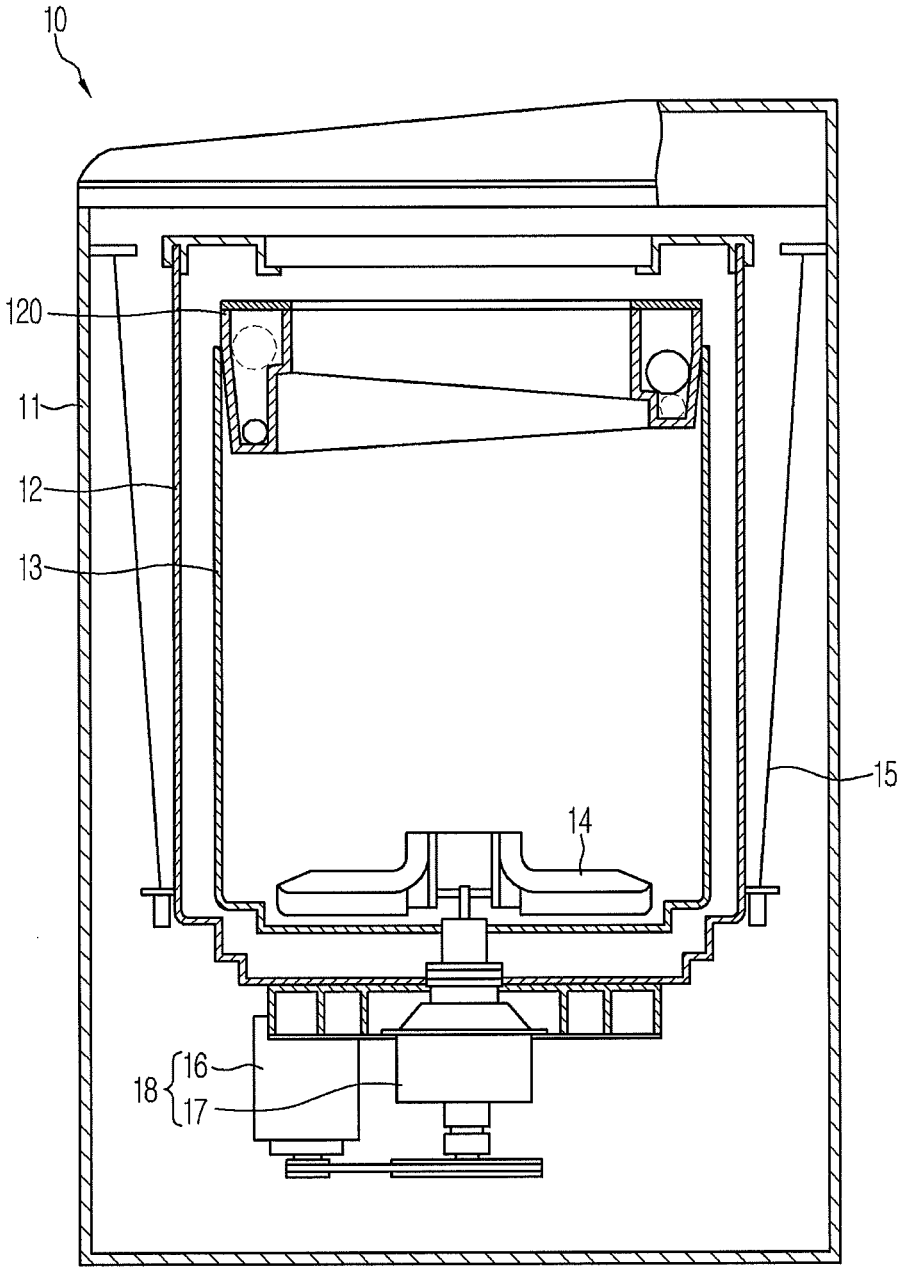
FIG. 6 is a longitudinal cross-sectional view showing a washing machine according to another embodiment of the present disclosure.
Figure 7:
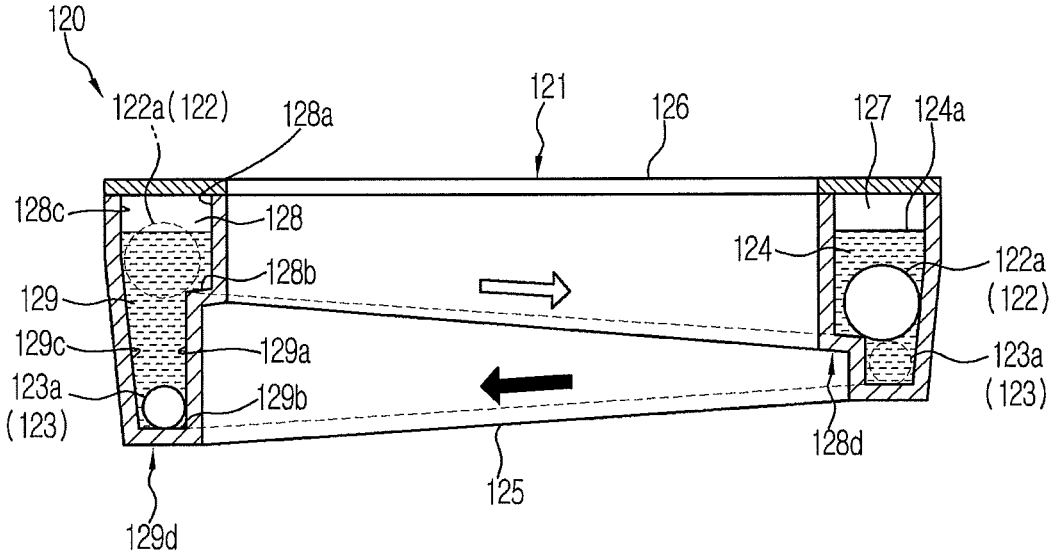
FIG. 7 is a lateral cross-sectional view showing a balancing device in stopping rotation of the spin basket.

As shown in FIGS. 6 to 11, a balancing device 120 according to another embodiment of the present disclosure is formed in a circular ring shape and mounted to the upper inner surface of the spin basket 13. FIG. 7 is a lateral cross-sectional view showing a balancing device 120 with the spin basket 13 stopped, and FIG. 8 a partially enlarged view showing the balancing device 120 of FIG. 7. The balancing device 120 has a ring-shaped casing 121 installed to be concentric with the spin basket 13. Accommodated in the casing 121 are a large-diameter balancing ball group 122 (a first balancing ball group) configured with a plurality of large-diameter balancing balls 122*a* (first balancing balls) having the same diameter, a small-diameter balancing ball group 123 (a second balancing ball group) configured with a plurality of small-diameter balancing balls 123*a* (second balancing balls) having the same diameter smaller than the diameter of the large-diameter balancing balls 122*a*, and a viscous fluid 124. The balancing balls 122*a* and 123*a* are all formed of a metal such as, for example, aluminum or iron. The total weight of the small-diameter balancing ball group 123 is balanced with the total weight of the large-diameter balancing ball group 122. In addition, the ratio $r_S/r_L$ of the radius $r_S$ of the small-diameter balancing ball 123*a* to the radius $r_L$ of the large-diameter balancing ball 122*a* may be between about 0.25 and about 0.9. The ratio $r_S/r_L$ may be between about 0.5 and about 0.7. Additionally, FIGS. 6 and 7 show one large-diameter balancing ball 122*a* and one small-diameter balancing ball 123*a*.

The casing 121 is formed of, for example, a resin in a circular ring shape. The casing 121 has a casing body 125 provided with a concave portion having an opening open upward, and a cover 126 approximately formed in a disk shape. The cover 126 closes the opening to form a ball accommodation portion 127 (also referred to as a race) to accommodate the large-diameter balancing ball group 122 and the small-diameter balancing ball group 123. In addition, the casing 121 is adapted to form weight balance. Specifically, the casing 121 is provided with a weight, which is not shown, mounted at a predetermined position.

The ball accommodation portion 127 includes an upper concave portion 128 formed in a circular ring shape to allow the large-diameter balancing ball group 122 to be accommodated therein to be movable in the circumferential direction of the ball accommodation portion 127, and a lower concave portion 129 integrally formed at the lower side of the upper concave portion 128 to allow the small-diameter balancing ball group 123 to be accommodated therein to be movable in the circumferential direction of the ball accommodation portion 127. The lower concave portion 129 formed at the lower side of the upper concave portion 128 extends from a radial position father from the outer end of the upper concave portion 128 than the center of the upper concave portion 128 in a radial direction to the outer end of the upper concave portion 128. The radial width $W_L$ of the lower concave portion 129 is less than the radial width $W_U$ of the upper concave portion 128. In addition, the radial width $W_L$ of the lower concave portion 129 is slightly greater than the diameter $2r_S$ of the small-diameter balancing ball 123*a*, and less than the radial width $W_U$ of the upper concave portion 128. The radial width $W_U$ of the upper concave portion 128 is slightly greater than the diameter $2r_L$ of the large-diameter balancing ball 122*a*.

The lower concave portion 129 is formed by an approximately vertical lower inner circumferential wall 129*a* formed in a round pipe shape, a flange-shaped lower bottom surface 129*b* radially protruding outward from the lower end of the lower inner circumferential wall 129*a*, and a round pipe-shaped lower outer circumferential wall 129*c* extending upward from the radial outer end of the lower bottom surface 129*b*. In addition, the upper concave portion 128 formed by an approximately vertical upper inner circumferential wall 128*a* formed in a round pipe shape and disposed at the upper side of the lower inner circumferential wall 129*a* and radially more inward than the lower inner circumferential wall 129*a*, a flange-shaped upper bottom surface 128*b* radially protruding outward from the lower end of the upper inner circumferential wall 128*a* and connected, at the radial outer end thereof, to the upper end of the lower inner circumferential wall 129*a*, and a round pipe-shaped upper outer circumferential wall 128*c* extending upward from the upper end of the lower outer circumferential wall 129*c*.

Figure 8:
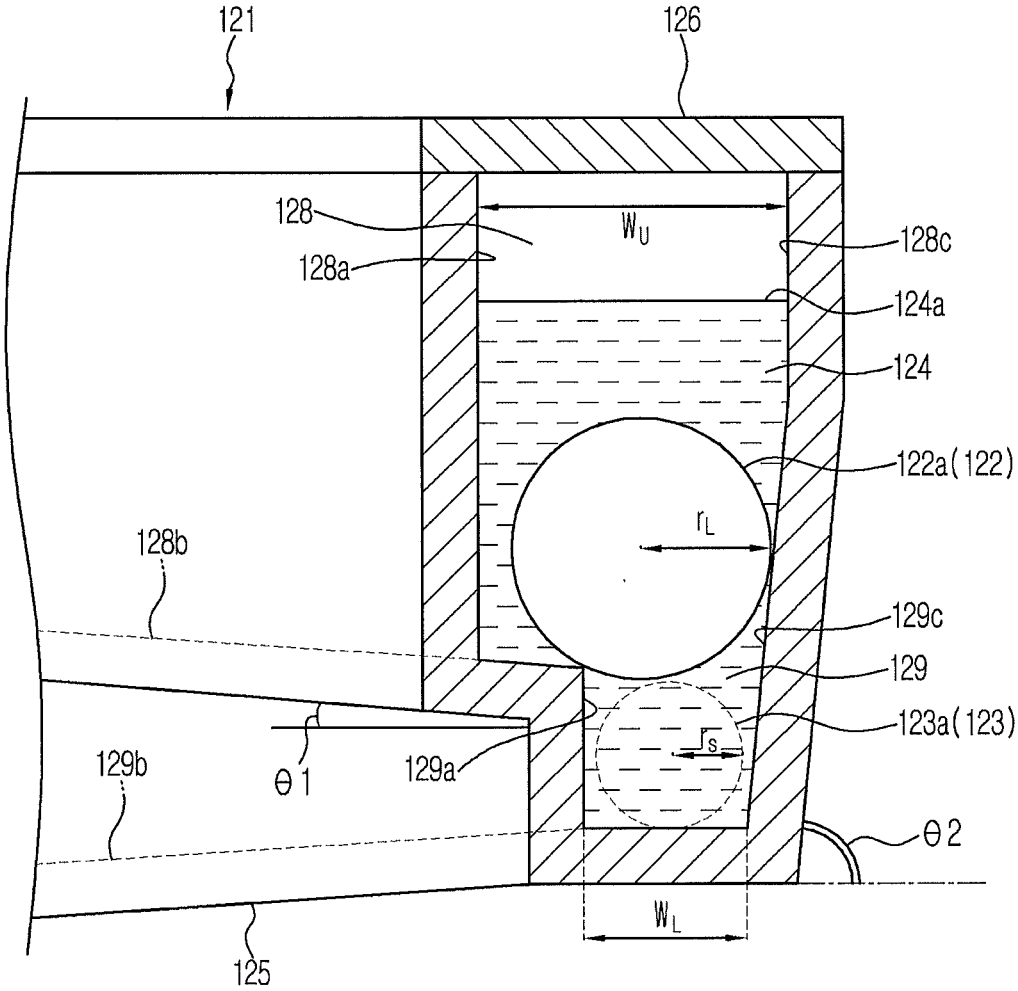
FIG. 8 is a partially enlarged view showing the balancing device of FIG. 7.

The lower bottom surface 129*b* and the upper bottom surface 128*b* are inclined in the circumferential direction, and the lowest points 129*d* and 128*d* thereof, which indicate the lowest positions on the lower bottom surface 129*b* and the upper bottom surface 128*b* are spaced 180° from each other in the circumferential direction to face each other when they are viewed in a vertical direction. That is, in FIG. 7, the lowest point 129*d* of the lower bottom surface 129*b* is positioned on the left side, and the lowest point 128*d* of the upper bottom surface 128*b* is positioned on the right side. As shown in FIG. 8, the upper bottom surface 128*b* is inclined downward in a radially outward direction, and the inclination angle θ1 thereof is equal to or greater than about 1° with respect to a horizontal plane. Further, the lower outer circumferential wall 129*c* is inclined upward in a radially outward direction, and the inclination angle θ2 thereof is equal to or greater than about 40° and less than about 90° with respect to a horizontal plane. By setting the inclination angle θ2 to be relatively large, the radial width of the casing 121 may be restricted and thus the balancing device 120 may become compact. Meanwhile, the lower end of the upper outer circumferential wall 128*c* is inclined upward in a radially outward direction. This inclined portion has the same inclination angle as that of the lower outer circumferential wall 129*c*, and a vertical dimension thereof increases as it approaches the lowest point 128*d* of the upper concave portion 128.

Figure 9:
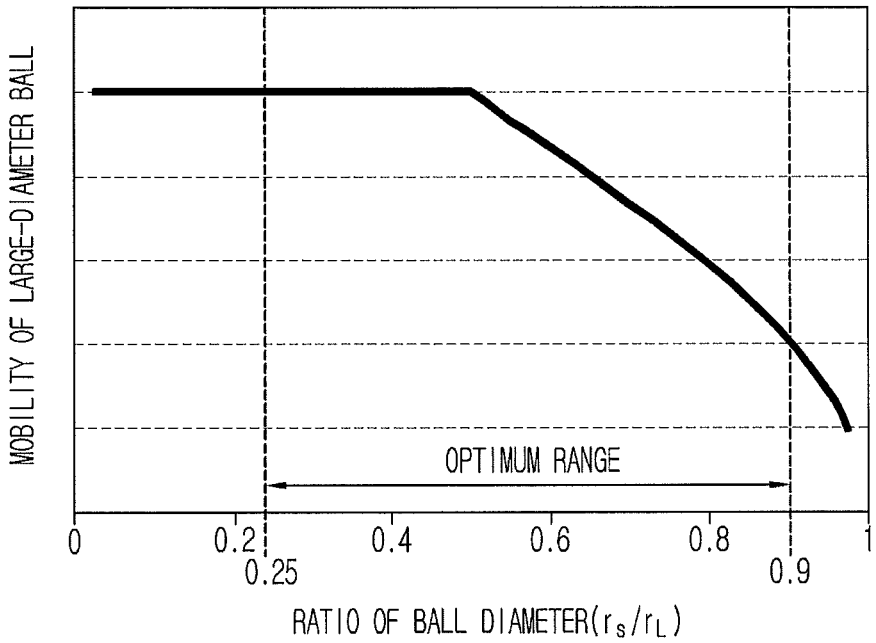
FIG. 9 is a graph illustrating a relationship between a diameter ratio of a small-diameter balancing ball to a large-diameter balancing ball and mobility of the large-diameter balancing ball.

In addition, as shown in FIG. 8, a portion of the lower end of the large-diameter balancing ball 122*a* is inserted into the lower concave portion 129. The volume of the inserted portion varies with the radius ratio $r_S/r_L$ between the balancing balls 122*a* and 123*a*. When the volume is large, the area of contact between the large-diameter balancing ball 122*a*, the upper bottom surface 128*b* and upper outer circumferential wall 128*c* becomes large, resulting in large friction. In this case, it is difficult for the large-diameter balancing ball 122*a* to roll on the upper bottom surface 128*b*. FIG. 9 is a graph illustrating a relationship between the radius ratio $r_S/r_L$ and mobility of the large-diameter balancing ball 122*a*, in which the horizontal axis represents the radius ratio $r_S/r_L$, and the vertical axis represents mobility of the large-diameter balancing ball 122*a* on the upper bottom surface 128*b*. As shown in FIG. 9, when the radius ratio $r_S/r_L$ is set to a value between about 0.25 and about 0.9, the large-diameter balancing ball 122*a* may relatively easily move. In addition, in view of restriction of the size of the balancing device 120, setting the radius ratio $r_S/r_L$ to be equal to or greater than about 0.25 may be practically desirable.

The viscous fluid 124 is configured with oil having a predetermined viscosity, and is accommodated in the ball accommodation portion 127 to a level causing the large-diameter balancing ball group 122 to be submerged. For example, the viscous fluid 124 fills about 80% of the volume of the ball accommodation portion 127.

Operation of Balancing Device

Figure 10:
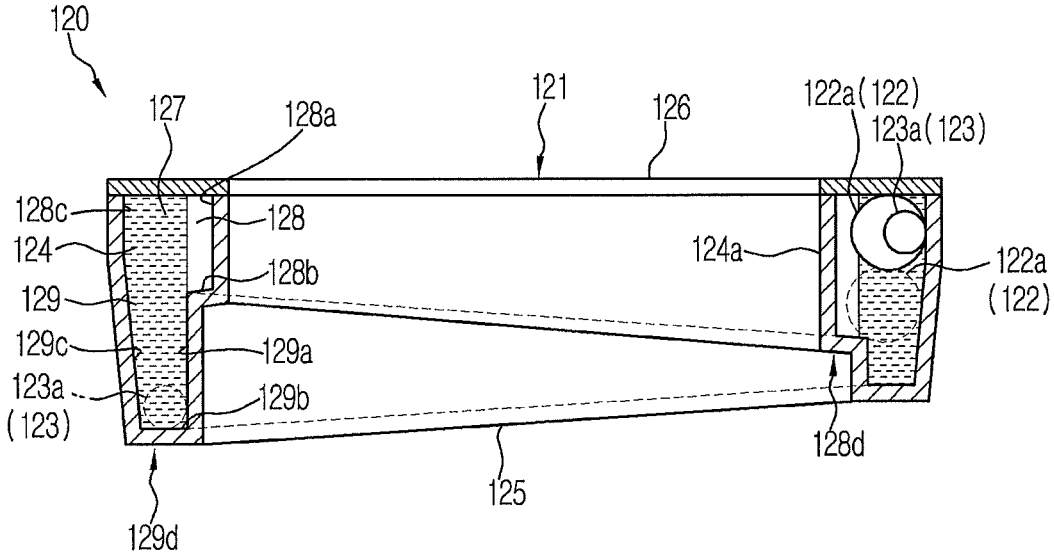
FIG. 10 is a view illustrating the state of the spin basket after passing the first resonance section, which corresponds to FIG. 7.

Hereinafter, operation of the balancing device 120 during the drying operation of the washing machine 10 will be described with reference to FIGS. 7, 8 and 10. FIG. 10 is a view illustrating the state of the spin basket 13 rotating at a high rate of rotation after passing the first resonance section during the drying operation, which corresponds to FIG. 7. Herein, the first resonance section is a range of rate of rotation in which the horizontal vibration (rocking rotating) of the spin basket 13 is maximized at the initial stage of the drying operation. Similar to FIGS. 6 and 7, FIG. 10 shows one large-diameter balancing ball 122*a* and one small-diameter balancing ball 123*a*.

When rotation of the spin basket 13 is stopped prior to start of the drying operation, the large-diameter balancing ball 122*a* accommodated in the upper concave portion 128 moves in the circumferential direction by rolling on the slope of the upper bottom surface 128*b* and gathers at the lowest point 128*d*, as shown in FIG. 7. Meanwhile, the small-diameter balancing balls 123*a* accommodated in the lower concave portion 129 move in the circumferential direction by rolling on the slope of the lower bottom surface 129*b*, and gather at the lowest point 129*d*. The lowest point 129*d* is at the position opposite to the lowest point 128*d* of the upper bottom surface 128*b*, when viewed in a vertical direction. Accordingly, the total weight of the large-diameter balancing ball group 122 is balanced with the total weight of the small-diameter balancing ball group 123 as described above. Thereby, the center of gravity of the large-diameter and small-diameter balancing ball groups 122 and 123 is on the axis of rotation of the spin basket 13. This weight balance is maintained until the rate of rotation of the spin basket 13 passes the first resonance section. Since the large-diameter and small-diameter balancing balls 122*a* and 123*a* are made to roll on the bottom surfaces 128*b* and 129*b* of the upper concave portion 128 and lower concave portion 129 and gather at one place due to gravity, automatically forming weight balance, unlike conventional cases, control of rotation of the spin basket 13 is not needed. Therefore, more energy and time may be saved than in the conventional cases. In addition, when the rate of rotation of the spin basket 13 passes (crosses) the first resonance section, variation in horizontal vibration of the spin basket 13 caused by maldistribution of the balancing balls 122*a* and 123*a* may be suppressed.

When the drying operation begins, the spin basket 13 starts to rotate. At this time, the balancing device 20 mounted to the spin basket 13 also starts to rotate together with the spin basket 13. By centrifugal force, the balancing balls 122*a* and 123*a* are moved in a radially outward direction and moved upward along the outer circumferential walls 128*c* and 129*c* while being pressed against the outer circumferential walls 128*c* and 129*c*. In addition, once the rate of rotation of the spin basket 13 passes the first resonance section, the balancing balls 122*a* and 123*a* are raised up to the upper end of the ball accommodation portion 127, and automatically moved in the circumferential direction to a position opposite to the maldistributed laundry. Thereby, balance of rotation of the spin basket 13 may be maintained.

When the rate of rotation of the spin basket 13 is relatively low, on the other hand, the viscous fluid 124 is accommodated such that the surface 124*a* thereof is almost level by gravity. When the rate of rotation of the spin basket 13 exceeds the first resonance section, the viscous fluid 124 is moved in a radially outward direction by centrifugal force, as shown in FIG. 10. Movement of the large-diameter and small-diameter balancing balls 122*a* and 123*a* in a circumferential direction is restricted by the viscous resistance of the viscous fluid 124 moved in a radially outward direction. As a result, collision between the balancing balls 122*a* and 123*a* or self-excited vibration and noise resulting therefrom may be suppressed during rotation of the spin basket 13.

When the drying operation of the washing machine 10 is terminated and thus the spin basket 13 rotates at a low rate, the viscous fluid 124 having been collected at a radially outer portion of the inside of the ball accommodation portion 127 flows downward by gravity. As a result, the viscous fluid 124 returns to its original state. When the rate of rotation of the spin basket 13 becomes equal to or lower than a predetermined rate of rotation in the section of low rate of rotation, the large and small balancing balls 122*a* and 123*a* respectively fall. At this time, the large-diameter balancing balls 122*a* are held in the upper concave portion 128 by the upper bottom surface 128*b* of the upper concave portion 128. Meanwhile, the small-diameter balancing balls 123*a* pass through the upper concave portion 128 and fall to the lower concave portion 129 below the upper concave portion 128 since the diameter thereof is smaller than the radial width WL the lower concave portion 129. At this time, a small-diameter balancing ball 123*a* may fall on the upper bottom surface 128*b* of the upper concave portion 128. In this case, the small-diameter balancing ball 123*a* moves along the radial slope of the upper bottom surface 128*b* in a radially outward direction and falls to the lower concave portion 129. Since the upper bottom surface 128*b* is inclined, the small-diameter balancing balls 123*a* may be prevented from staying on the upper bottom surface 128*b*.

Finally, when rotation of the spin basket 13 is stopped, the large-diameter balancing balls 122*a* move in the circumferential direction (the direction indicted by a white arrow in FIG. 7) by rolling on the upper bottom surface 128*b* and gather at the lowest point 128*d* of the upper bottom surface 128*b*. In addition, the small-diameter balancing balls 123*a* in the circumferential direction (the direction indicted by a black arrow in FIG. 7) by rolling on the lower bottom surface 129*b* and gather at the lowest point 129*d* at the opposite side of the lowest point 128*d* of the upper bottom surface 128*c*. Thereby, the large and small balancing balls 122*a* and 123*a* return to the original state thereof. Accordingly, the center of gravity of the large-diameter and small-diameter balancing ball groups 122 and 123 may be positioned on the axis of rotation of the spin basket 13 to form weight balance of the balancing device 120.

Figure 11:
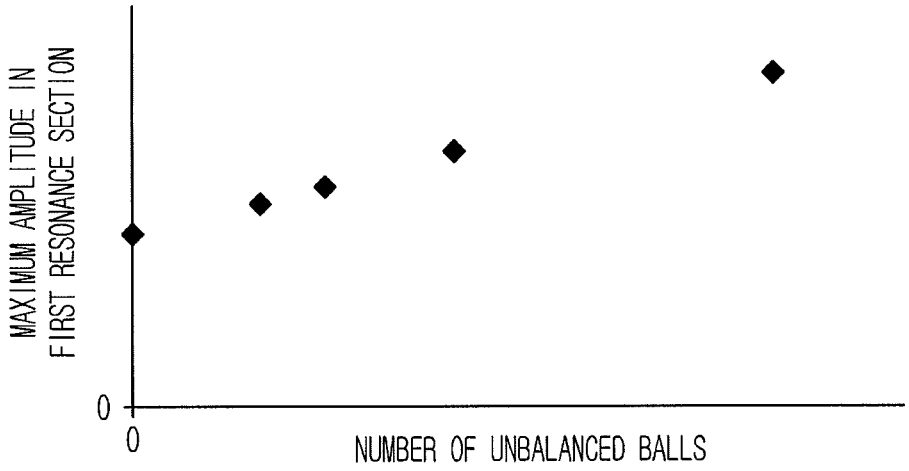
FIG. 11 is a graph illustrating an example of the relationship between the state of weight balance between the balancing balls and the viscous fluid and variation in horizontal vibration of the spin basket.

FIG. 11 is a graph illustrating an example of the relationship between the state of weight balance between the balancing balls 122*a* and 123*a* and the viscous fluid 124 and variation in horizontal vibration of the spin basket 13. In FIG. 11, the horizontal axis represents the number of balancing balls 122*a* and 123*a* that do not form weight balance, and the vertical axis represents the maxim amplitude of vibration of the spin basket 13 when the rate of rotation of the spin basket 13 passes the first resonance section. The illustrated embodiment corresponds to the case of having no balancing balls 122*a* and 123*a* failing to form weight balance. As shown in FIG. 11, as the number of balancing balls 122*a* and 123*a* that do not form weight balance increases, the maximum amplitude of vibration of the spin basket 3 increases and thus variation in horizontal vibration of the spin basket 13 also increases. Therefore, it may be desirable that the total weight of the large-diameter balancing ball group 122 is balanced with the total weight of the small-diameter balancing ball group 123 as in the illustrated embodiment.

Other Embodiments

In the previous embodiment, two types of the balancing balls 122*a* and 123*a* are used. However, embodiments of the present disclosure are not limited thereto. Three or more types of balancing balls may be used. If the number of types of balancing balls increases, however, the volume of the ball accommodation portion 127 may need to be increased. Accordingly, using two types of balancing balls may be most suitable in view of making the device compact.

As is apparent from the above description, the bottom surface of the ball accommodation portion is inclined downward as the bottom surface extends from a position of the fluid accommodation portion to an opposite position such that the balancing balls gather at the opposite position facing the fluid accommodation portion when rotation of the spin basket is stopped. Thereby, when rotation of the spin basket is stopped, weight balance is automatically formed among the balancing balls and the viscous fluid in the ball accommodation portion and the viscous fluid in the fluid accommodation portion. As a result, variation in horizontal vibration of the spin basket due to maldistribution of the balancing balls may be suppressed when the rate of rotation of the spin basket passes the first resonance section, even without moving the balancing balls to a position at which weight balance is formed between the balancing balls and the viscous fluid.

In addition, since the balancing balls roll on the bottom surfaces of the respective concave portions and gather at one place due to gravity, thereby automatically forming weight balance, special control is not needed as in conventional cases. Accordingly, waste of time and energy may be prevented.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A washing machine comprising an outer tub, a spin basket rotatably installed in the outer tub, and a balancing device mounted to the spin basket, wherein the balancing device comprises:

a ring-shaped casing installed to be concentric with the spin basket, and provided to accommodate a plurality of balancing balls and a viscous fluid;

a ring-shaped ball accommodation portion formed in the ring-shaped casing to accommodate the balancing balls; and a fluid accommodation portion disposed at a lower inner side of the ball accommodation portion in a radial direction of the ball accommodation portion, and provided to accommodate the viscous fluid, wherein a communication channel provided to allow the ball accommodation portion to communicate with the fluid accommodation portion is formed in the casing, the fluid accommodation portion is provided at the casing, the fluid accommodation semi-circular portion being formed in a portion of the casing along a circumferential direction of the casing, and a bottom surface of the ball accommodation portion is inclined downward as the bottom surface extends from a position of the fluid accommodation portion to a lowermost opposite position facing the fluid accommodation portion such that the balancing balls are positioned at the lowermost opposite position when rotation of the spin basket is stopped.

2. The washing machine according to claim 1, wherein:

a majority of the viscous fluid is accommodated in the fluid accommodation portion and a remaining portion of the viscous is accommodated in the ball accommodation portion, when rotation of the spin basket is stopped; and the balancing device is configured such that weight balance is formed, when rotation of the spin basket is stopped, among the balancing balls having gathered at the opposite position to the fluid accommodation portion, the viscous fluid in the ball accommodation portion, and the viscous fluid in the fluid accommodation portion.

3. The washing machine according to claim 2, wherein:

the communication channel is configured not to allow the balancing balls to move from the ball accommodation portion to the fluid accommodation portion; and the balancing device is configured such that when a rate of rotation of the spin basket is lower than a predetermined rate of rotation, the viscous fluid is accommodated in the fluid accommodation portion due to gravity, and when the rate of rotation of the spin basket is equal to or higher than the predetermined rate of rotation, the viscous fluid in the fluid accommodation portion is moved into the ball accommodation portion through the communication channel by centrifugal force.

4. The washing machine according to claim 1, wherein the casing comprises a casing body having an opening open upward, and a cover to cover the opening of the casing body, wherein a partition wall is integrally formed on a lower surface of the cover to protrude downward from the lower surface to partition the communication channel.

5. A washing machine comprising:

an outer tub;

a spin basket rotatably installed in the outer tub; and a balancing device mounted to the spin basket, wherein the balancing device comprises a ring-shaped casing having a ball accommodation portion to accommodate balancing balls, a fluid accommodation portion to accommodate a viscous fluid, the fluid accommodation portion being formed in a semi-circular portion of the casing along a circumferential direction of the casing, and a communication channel connecting the ball accommodation portion with the fluid accommodation portion, and a bottom surface of the ball accommodation portion being inclined downward as the bottom surface extends from a position of the fluid accommodation portion to a lowermost opposite position facing the fluid accommodation portion such that the balancing balls are positioned at the lowermost opposite position when rotation of the spin basket is stopped.

6. The washing machine according to claim 5, wherein the fluid accommodation portion is dimensioned and configured so that a majority of the viscous fluid is accommodated in the fluid accommodation portion and a remaining portion of the viscous is accommodated in the ball accommodation portion.

7. The washing machine according to claim 6, wherein the communication channel is configured not to allow the balancing balls to move from the ball accommodation portion to the fluid accommodation portion.

8. The washing machine according to claim 5, wherein the casing comprises a casing body having an opening open upward, and a cover to cover the opening of the casing body, wherein a partition wall is integrally formed on a lower surface of the cover to protrude downward from the lower surface to partition the communication channel.

* * * * *

UNITED STATES PATENT AND TRADEMARK OFFICE

CERTIFICATE OF CORRECTION

PATENT NO. : 9,169,591 B2
APPLICATION NO. : 14/022704
DATED : October 27, 2015
INVENTOR(S) : Ohyagi Atsushi et al.

It is certified that error appears in the above-identified patent and that said Letters Patent is hereby corrected as shown below:

IN THE SPECIFICATION

Column 1, Line 9

Before “filed” delete “both”.

Column 1, Line 10

Delete “Sep. 14, 2012” and insert --Sep. 24, 2012 and Sep. 14, 2012, respectively,--, therefor.

Signed and Sealed this
Second Day of February, 2016

Michelle K. Lee

Michelle K. Lee
*Director of the United States Patent and Trademark Office*